US006046414A

United States Patent [19]

Hirschfeld

[11] Patent Number: 6,046,414

[45] Date of Patent: Apr. 4, 2000

[54] SWITCH ASSEMBLY

[75] Inventor: Klaus Hirschfeld, Ludenscheid, Germany

[73] Assignee: Leopold Kostal GmbH & Co. KG, Ludenscheid, Germany

[21] Appl. No.: 09/035,224

[22] Filed: Mar. 5, 1998

[30] Foreign Application Priority Data

Jun. 19, 1997 [DE] Germany ..... 197 26 149

[51] Int. Cl.[7] ..... H01H 17/02

[52] U.S. Cl. ..... 200/18; 200/553; 200/559; 200/551

[58] Field of Search ..... 200/545, 548, 200/550, 551, 553, 559, 329, 330, 17 R, 18, 332.1–339

[56] References Cited

U.S. PATENT DOCUMENTS

| | | |
|---|---|---|
| 4,606,459 | 8/1986 | Luray . |
| 4,903,827 | 2/1990 | Phelps et al. . |
| 4,923,065 | 5/1990 | Ridgeway . |
| 5,056,665 | 10/1991 | Boecker et al. . |
| 5,218,510 | 6/1993 | Bradford . |
| 5,226,542 | 7/1993 | Boecker et al. . |
| 5,323,896 | 6/1994 | Jones . |
| 5,388,701 | 2/1995 | Ridgeway . |
| 5,579,917 | 12/1996 | Lofgren et al. . |
| 5,669,506 | 9/1997 | Lofgren et al. . |
| 5,678,695 | 10/1997 | Ridgeway et al. . |

FOREIGN PATENT DOCUMENTS

| | | |
|---|---|---|
| 39 31 722 C 2 | 4/1994 | Germany . |
| 1425746 | 2/1976 | United Kingdom . |

*Primary Examiner*—Michael L. Gellner
*Assistant Examiner*—Nhung Nguyen
*Attorney, Agent, or Firm*—Brooks & Kushman, P.C.

[57] ABSTRACT

A switch assembly includes a housing having a longitudinal axis and a transverse axis. The housing has a pair of spaced apart longitudinally extending walls each having a control curve. An actuating element is mounted to the housing. The actuating element is longitudinally movable along the longitudinal axis between two switching positions and is pivotable about the transverse axis between two other switching positions. A first switching piece is coupled to the actuating element to pivot as the actuating element pivots. A first pair of movable electrical switching contacts is associated with the first switching piece. The first switching piece moves one of the first pair of switching contacts as the actuating element pivots. A second switching piece is coupled to the actuating element to pivot as the actuating element longitudinally moves. A second pair of movable electrical contacts is associated with the second switching piece. The second switching piece moves one of the second pair of switching contacts as the actuating element longitudinally moves. A control device extends transversely across the housing. The control device has two spring loaded pressure pieces which each engage one of the control curves of the two walls to be biased to move the actuating element from a switching position to return to an initial position.

9 Claims, 4 Drawing Sheets

SWITCH ASSEMBLY

TECHNICAL FIELD

The present invention relates to electrical switch assemblies for sliding-rising-roofs of a motor vehicle remotely actuated by an auxiliary force, by means of which the adjusting drives of the roof for the sliding roof function can be activated by oppositely directed sliding movements of a control element and by means of which the adjusting drives for the rising roof function can be activated by oppositely directed pivot movements of the control element.

BACKGROUND ART

Switch assemblies of the aforementioned type interrupt and complete electrical circuits by moving electrical switching contacts disposed in the housing of the switch assembly to contact fixed electrical switching contacts. It is thus possible for a user to apply an auxiliary force to an actuating element to switch on and off functions associated with different electrical circuits. Often such switch assemblies switch on and off the sliding and rising roof functions of a sliding-rising-roof of a motor vehicle.

DE 39 31 722 C2 discloses a switch assembly having a housing which receives movable electrical switching contacts. The housing has a transverse axis and a longitudinal axis. An actuating element is mounted on the housing. Each of two axle journals associated with the actuating element engage a longitudinally elongated hole provided in opposite walls of the housing in parallel with the longitudinal axis. The two axle journals are rotatable and longitudinally displaceable within the elongated holes such that the actuating element is pivotable about the transverse axis and longitudinally movable along the longitudinal axis to move between switching positions.

The actuating element includes two guide cams each spaced apart from an axle journal in parallel with the longitudinal axis. The guide cams each engage a cross-shaped connecting member provided on the opposite walls of the housing to enable the actuating element to be pivotable and longitudinally movable. The actuating element can therefore be moved to switching positions by sliding and pivoting movements which correspond to the movements of a sliding-rising-roof of a motor vehicle.

The actuating element includes switching pieces which transmit the actuating element movements to the movable switching contacts to complete electrical circuits and enable switching functions associated with the switching positions. Furthermore, the switch assembly includes a plurality of compression spring-loaded control devices which ensure that the actuating element remains in a starting position and automatically returns from a switching position to the starting position. A problem associated with the switch assembly disclosed in DE 39 31 722 C2 is that the switch assembly includes a considerable number of individual parts which are complicated to assemble resulting in considerable assembly costs.

DE 34 15 997 C2 discloses a switch assembly wherein movements of the actuating element correspond to the movements of a sliding-rising-roof of a motor vehicle. The actuating element also includes two axle journals which are rotatable and longitudinally movable within elongated holes provided in opposite walls of the housing. The actuating element further includes two guide cams which pivotable and longitudinally displaceable engage a respective cross-shaped connecting member of the housing.

SUMMARY OF THE INVENTION

Accordingly, it is an object of the present invention to provide a switch assembly for a sliding-rising-roof of a motor vehicle which maintains a high degree of functionability and compact design, yet consists of exceptionally few individual parts which are convenient to assemble.

In carrying out the above object and other objects, features, and advantages, the present invention provides a switch assembly including a housing having a longitudinal axis and a transverse axis. The housing has a pair of spaced apart longitudinally extending walls each having a control curve. An actuating element is mounted to the housing. The actuating element is longitudinally movable along the longitudinal axis between first and second switching positions and is pivotable about the transverse axis between third and fourth switching positions.

A first switching piece is coupled to the actuating element to pivot as the actuating element pivots. A first pair of movable electrical switching contacts is associated with the first switching piece. The first switching piece moves one of the first pair of switching contacts to enable a switching function associated with the third switching position when the actuating element pivots to the third switching position. The first switching position moves the other one of the first pair of switching contacts to enable a switching function associated with the fourth switching position when the actuating element pivots to the fourth switching position.

A second switching piece is coupled to the actuating element to pivot as the actuating element longitudinally moves. A second pair of movable electrical contacts is associated with the second switching piece. The second switching piece moves one of the second pair of switching contacts to enable a switching function associated with the first switching position when the actuating element longitudinally moves to the first switching position. The second switching piece moves the other one of the second pair of switching contacts to enable a switching function associated with the second switching position when the actuating element pivots to the second switching position.

A control device extends transversely across the housing substantially in parallel with the transverse axis. The control device has two spring loaded pressure pieces which each engage one of the control curves of the longitudinally extending walls to be biased to move the actuating element from a switching position to return to an initial position.

The advantages accruing to the present invention are numerous. The control curves of the two longitudinally extending walls may be arranged to either automatically return the actuating element from a switching position to the initial position or lock the actuating element in a switching position until a user moves the actuating element back towards the initial position.

These and other features, aspects, and embodiments of the present invention will become better understood with regard to the following description, appended claims, and accompanying drawings.

BEST MODES FOR CARRYING OUT THE INVENTION

Figure 1:
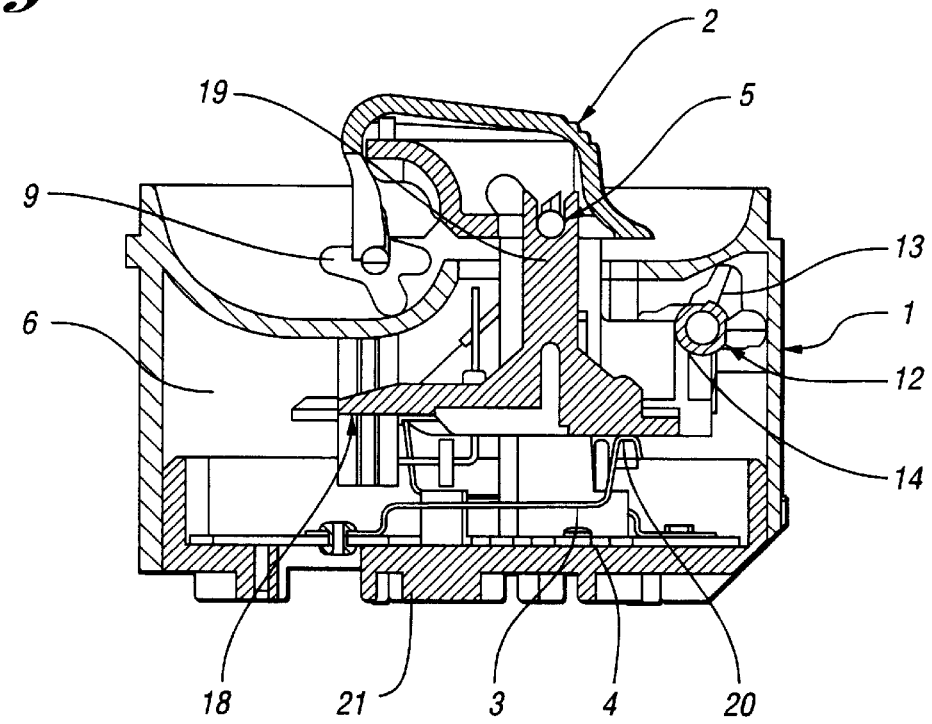
FIG. 1 illustrates a full sectional view of a switch assembly in accordance with the present invention along the line A—A of FIG. 3.
Figure 2:
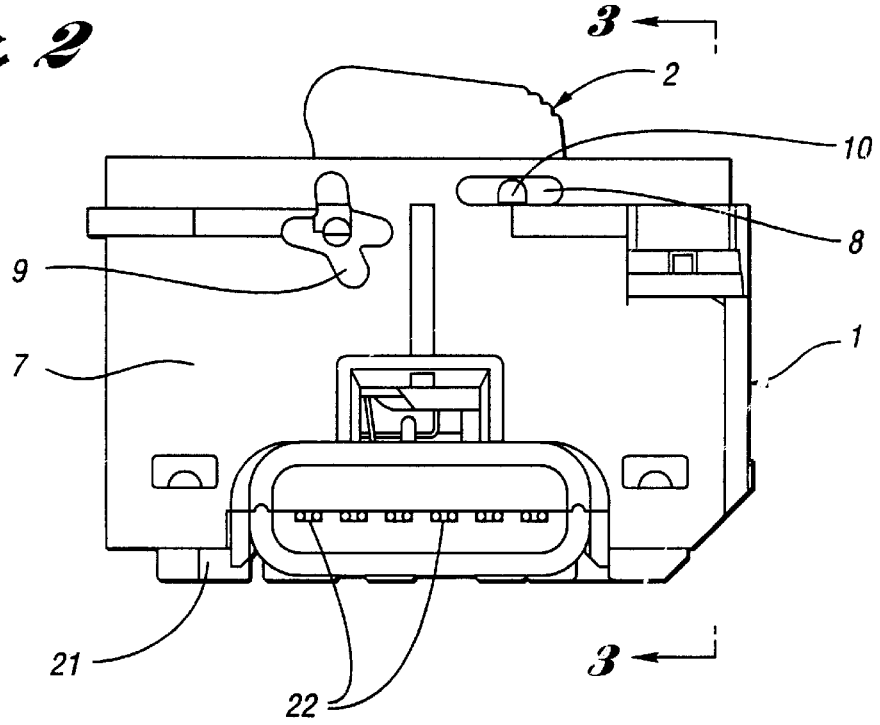
FIG. 2 illustrates a lateral view of the switch assembly.
Figure 3:
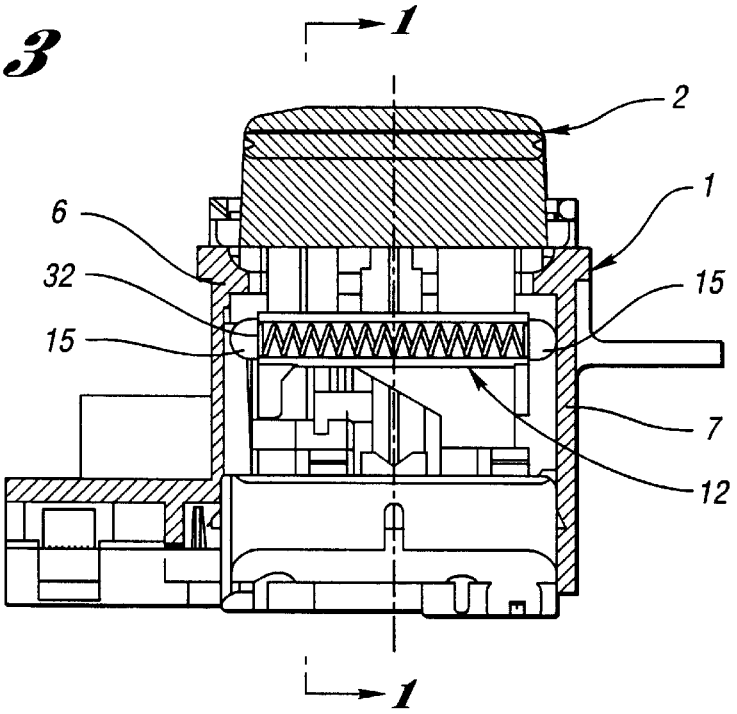
FIG. 3 illustrates a cross-sectional frontal view of the switch assembly along the line B—B of FIG. 2.
Figure 4:
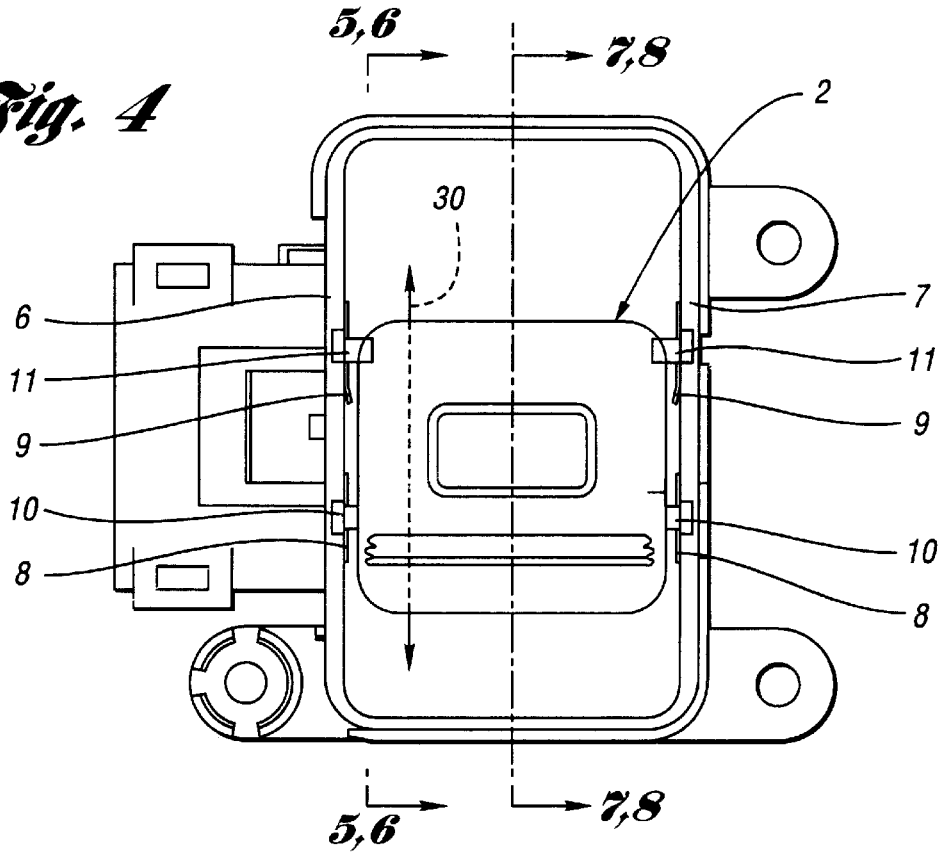
FIG. 4 illustrates a plan view of the switch assembly.

Referring now to FIGS. 1–8, a switch assembly according to the present invention is shown. The switch assembly includes a housing 1 and an actuating element 2 which is mounted on the housing. Actuating element 2 is movable between switching positions. The switch assembly further includes movable electrical switching contacts 3 disposed in housing 1. Movement of actuating element 2 causes switching contacts 3 to move between switching positions in relation to fixedly held switching contacts 4 disposed in housing 1 to complete electrical circuits and enable switching functions associated with the switching positions.

As is particularly evident in FIGS. 4–8, actuating element 2 is longitudinally displaceable along a longitudinal axis of housing 1 and is pivotable about a transverse axis 5 of the housing. Transverse axis 5 extends perpendicular to the longitudinal axis. Each of two opposite longitudinally extending walls 6 and 7 of housing 1 include an elongated hole 8 and a cross-shaped connection member 9. Elongated holes 8 and cross-shaped connection members 9 are longitudinally spaced apart along walls 6 and 7 of housing 1 and are window-like slots.

Actuating element 2 includes two axle journals 10 and two guide cams 11. Axle journals 10 represent an extension of transverse axis 5 and each engage in a respective one of elongated holes 8. Axle journals 10 are rotatable and longitudinally displaceable within elongated holes 8 such that actuating element 2 is pivotable about transverse axis 5 and longitudinally movable along the longitudinal axis 30 to move between the switching positions.

Guide cams 11 are pivotable and longitudinally displaceable. They engage cross-shaped connecting members 9 to enable actuating element 2 also to be pivotable and longitudinally movable. Actuating element 2 can therefore be moved to switching positions by sliding and pivoting movements which movements correspond to the movements of a sliding-rising-roof of a motor vehicle.

Actuating element 2 is movable from an initial position to four different switching positions. Counter-rotating longitudinal displacement of actuating element 2 causes the actuating element to move between first and second switching positions. Counter-rotating pivoting of actuating element 2 causes the actuating element to move between third and fourth switching positions.

A control device 12 formed on actuating element 2 and two cross-shaped control curves 13 provided on walls 6 and 7 of housing 1 are operable with the actuating element to precisely position the actuating element in the initial position and to automatically return the actuating element to the initial position from the switching positions. Control device 12 includes a receiving sleeve 14 extending transversely across actuating element 2 in parallel with transverse axis 5. Receiving sleeve 14 is provided at the end region of a rocker-shaped projection 23 of actuating element 2. Rocker-shaped projection 23 is connected to a first switching piece 17.

Receiving sleeve 14 includes two pressure pieces 15 and a helical compression spring 32. Cross-shaped control curves 13 are positioned, as are elongated holes 8 and cross-shaped connecting members 9, directly opposite from one another in walls 6 and 7. Cross-shaped connecting members 9 and cross-shaped control curves 13 are longitudinally spaced apart from each other in each of walls 6 and 7 such that elongated holes 8 are positioned in the middle between them.

Each of cross-shaped control curves 13 includes four restoring incline control paths. Each of the restoring incline control paths extend upwards from a central locking cut-out 16. Spring-loaded pressure pieces 15 engage into locking cut-outs 16 to maintain actuating element 2 in the starting position. Thus, actuating element 2 cannot unintentionally, for example, by means of vibration, be moved out of the starting position.

The restoring incline control paths of the control curves 13 cause the helical compression spring 32 to become increasingly biased as actuating element 2 moves to the switching positions. After actuating element 2 is moved to a switching position the helical compression spring 32 is biased to move pressure pieces 15 downward along the restoring incline control paths of control curves 13 to locking cut-outs 16 thereby automatically moving actuating element 2 from the switching position back to the starting position. Depending upon the application, each of the control paths can be provided with another locking cut-out on the end lying remote from central locking cut-out 16. Thus, actuating element 2 remains in the switching position after movement in one direction until it is intentionally actuated again by a user in the opposing direction.

Referring now to FIG. 1 with continual reference to FIGS. 4–8, first switching piece 17 is on the lowerside of actuating element 2 as mentioned above. A second switching piece 18 has a fork-shaped top side 19 coupled to actuating element 2 along transverse axis 5. First and second switching pieces 17 and 18 are formed substantially in a T-shape each having a transverse cross-piece contacting a pair of movable switching contacts 3.

Switching contacts 3 are longitudinally extending switching springs each having an actuating projection 20 at one end. Switching contacts 3 are pre-stressed with their actuating projections 20 contacting against opposite ends of the transverse cross-pieces of first and second switching pieces 17 and 18.

First and second pairs of switching contacts 3*a*, 3*b*, 3*c*, 3*d* are associated with first and second switching pieces 17 and 18, respectively. Each actuating projection 20*c*, 20*d* of the first pair of switching contacts 3*c*, 3*d* contacts opposite end regions of the transverse cross-piece of first switching piece 17. Similarly, each actuating projection 20*a*, 20*b* of the second pair of switching contacts 3*a*, 3*b* contacts opposite end regions of the transverse cross-piece of second switching piece 18.

As best shown in FIG. 1, movable and fixed electrical switching contacts 3 and 4 are disposed on a base piece 21 of housing 1. Fixed switching contacts 4 are fixed to base piece 21. Switching contacts 3 are fixedly connected at one end opposite from actuating projections 20 to separated strip conductors on base piece 21. The conductors extend outwardly from housing 1 into plug-in contact parts 22. A protective collar encompasses plug-in contact parts 22 to provide a reliable connection with a connecting contact part. The protective collar is a part of base piece 21 and housing 1. Movable switching contacts 3 contact fixed switching contacts 4 to close electrical circuits and enable switching functions associated with the switching positions.

Figure 5:
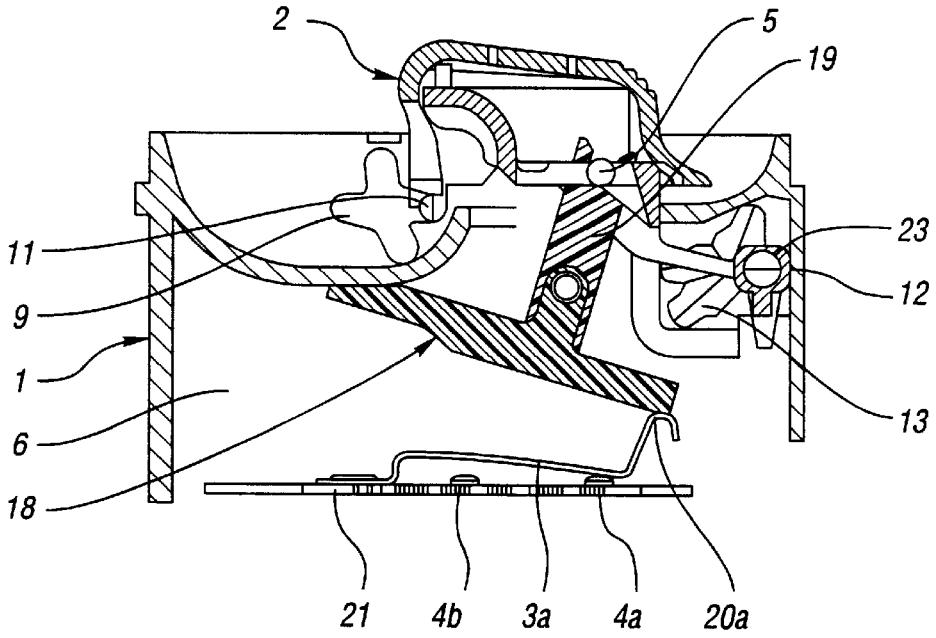
FIG. 5 illustrates a sectional view of the switch assembly in a first switching position along the line C—C of FIG. 4.
Figure 6:
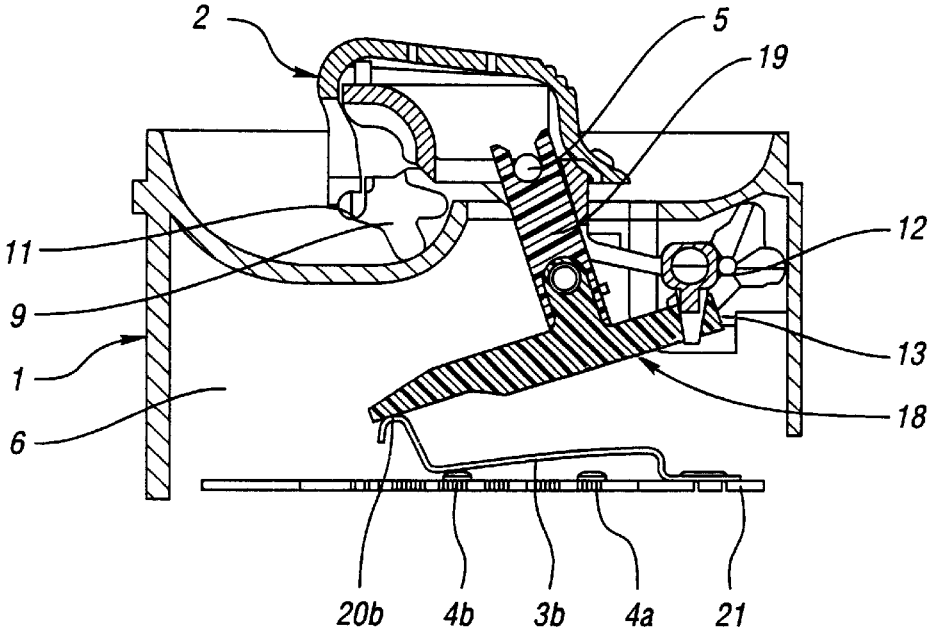
FIG. 6 illustrates a sectional view of the switch assembly in a second switching position along the line C—C of FIG. 4.
Figure 7:
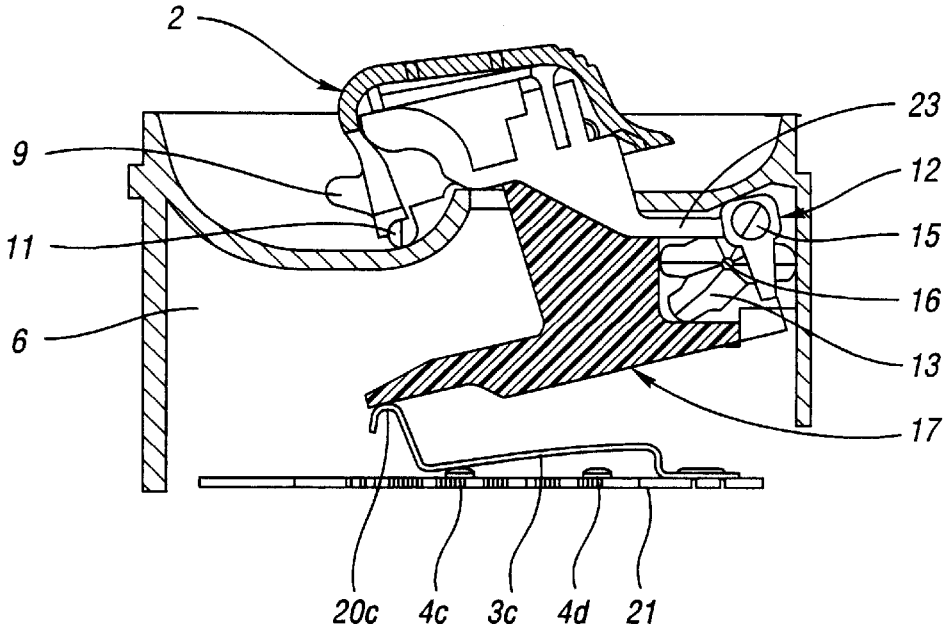
FIG. 7 illustrates a sectional view of the switch assembly in a third switching position along the line D—D of FIG. 4.
Figure 8:
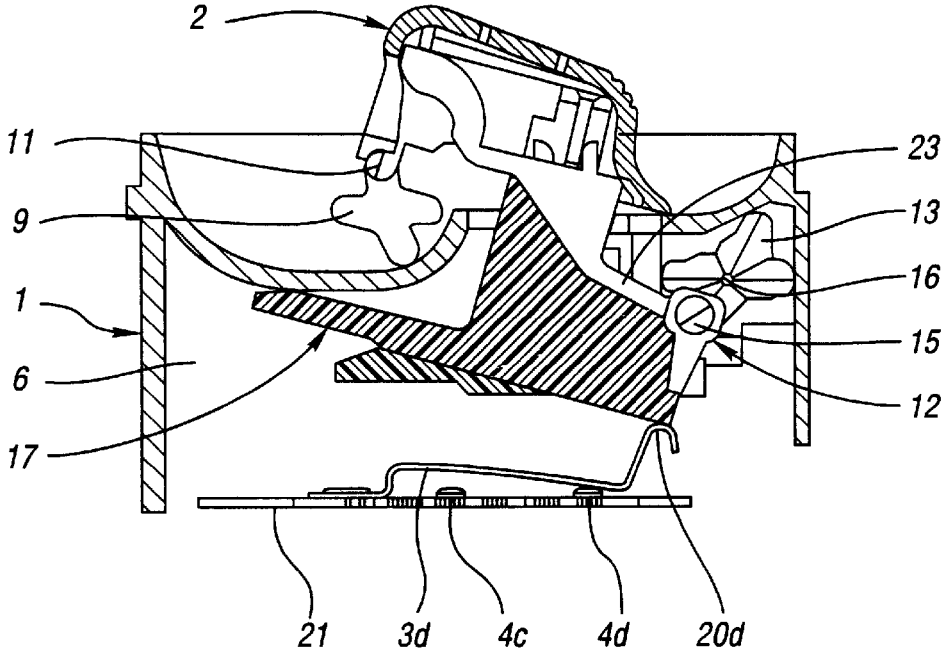
FIG. 8 illustrates a sectional view of the switch assembly in a fourth switching position along the line D—D of FIG. 4.

As best shown in FIGS. 5–8, only a single movable switching contact 3 is moved to contact the associated fixed switching contact 4 when actuating element 2 moves to one of the four switching positions. Specifically, first switching piece 17 pivots as actuating element 2 pivots to move one of the first pair of switching contacts 3*c*, 3*d* (as shown in FIGS. 7–8). Because of the counter-rotating pivot movements of actuating element 2, first switching piece 17 only moves one of the first pair of switching contacts 3*c*, 3*d* to contact the associated fixed switching contact 4*c*, 4*d*. Second switching piece 18 remains motionless while actuating element 2 pivots. Thus, the second pair of switching contacts 3*a*, 3*b* do not move as actuating element 2 pivots.

Second switching piece 18 pivots as actuating element 2 longitudinally moves to move one of the second pair of swithing contacts 3*a*, 3*b* (as shown in FIGS. 5–6). Because of the counter-rotating displacement movements of actuating element 2, second switching piece 18 only moves one of the second pair of switching contacts 3*a*, 3*b* to contact the associated fixed switching contact 4*a*, 4*b*. First switching piece 17 remains motionless while actuating element 2 longitudinally moves. Thus, the first pair of switching contacts 3*c*, 3*d* do not move as actuating element 2 longitudinally moves.

The resilient forces latently produced during the movement of switching contacts 3 assist in moving actuating element 2 from a switching position to return to the initial position. If, however, only control currents are to be switched by means of such a switch assembly, it is readily possible to design the movable electrical switching contacts as dome switching mats and to combine all fixed switching contacts accordingly on an electrical printed circuit board provided with copper-covered strip conductors.

As best shown in FIG. 5, actuating element 2 longitudinally moves into a first switching position. Second switching piece 18 is articulately coupled to actuating element 2 along transverse axis 5 by fork-shaped top side 19 so that movement of the actuating element in one longitudinal direction pivots the second switching piece to move one of the second pair of switching contacts 3*a*. Second switching piece 18 moves the one of the second pair of switching contacts 3 to enable a switching function associated with the first switching position, so that, for example, the roof is slid closed.

As best shown in FIG. 6, actuating element 2 longitudinally moves into a second switching position. Second switching piece 18 is articulately coupled to actuating element 2 along transverse axis 5 by fork-shaped top side 19 so that movement of the actuating element in the other longitudinal direction pivots the second switching piece to move the other one of the second pair of switching contacts 3*b*. Second switching piece 18 moves the other one of the second pair of switching contacts 3*b* to enable a switching function associated with the second switching position, so that, for example, the roof is slid open.

As best shown in FIG. 7, actuating element 2 pivots into the first switching position. First switching piece 17 is coupled to actuating element 2 so that pivoting of the actuating element in one pivot direction pivots the first switching piece to move one of the first pair of switching contacts 3*c* to enable a switching function associated with the third switching position, so that, for example, the roof descends to close.

As best shown in FIG. 8, actuating element 2 pivots into the second position. First switching piece 17 is coupled to actuating element 2 so that pivoting of the actuating element in the other pivot direction pivots the second switching piece to move the other one of the first pair of switching contacts 3*d* to enable a switching function associated with the fourth switching position, so that, for example, the roof is risen open.

Thus, it is apparent that there has been provided, in accordance with the present invention, a switch assembly that fully satisfies the object, aims, and advantages set forth above.

While the present invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A switch assembly comprising:

a housing having a longitudinal axis and a transverse axis, the housing having a pair of spaced apart longitudinal walls each having a control curve;

an actuating element mounted to the housing, wherein the actuating element is longitudinally movable along the longitudinal axis between first and second switching positions and is pivotable about the transverse axis between third and fourth switching positions;

a first switching piece coupled to the actuating element to pivot as the actuating element pivots;

a first pair of movable electrical switching contacts associated with the first switching piece, wherein the first switching piece moves one of the first pair of switching contacts to enable a switching function associated with the third switching position when the actuating element pivots to the third switching position and moves the other one of the first pair of switching contacts to enable a switching function associated with the fourth switching position when the actuating element pivots to the fourth switching position;

a second switching piece coupled to the actuating element to pivot as the actuating element longitudinally moves;

a second pair of movable electrical contacts associated with the second switching piece, wherein the second switching piece moves one of the second pair of switching contacts to enable a switching function associated with the first switching position when the actuating element longitudinally moves to the first switching position and moves the other one of the second pair of switching contacts to enable a switching function associated with the second switching position when the actuating element pivots to the second switching position; and a control device extending transversely across the housing along the transverse axis, the control device having two spring loaded pressure pieces loaded by a spring, wherein each of the two spring loaded pressure pieces engage a respective one of the control curves of the two longitudinal walls to be biased to move the actuating element from the switching positions to return to an initial position.

2. The switch assembly of claim 1 wherein:

the second switching piece includes a fork-shaped top side coupled to the actuating element along the transverse axis.

3. The switch assembly of claim 2 wherein:

the first and the second switching pieces each include transverse cross-pieces which contact the associated switching contacts.

4. The switch assembly of claim 1 wherein:

the switching contacts are longitudinally extending switching springs.

5. The switch assembly of claim 4 wherein:

each of the switching contacts includes an actuating projection which contacts the associated switching pieces.

6. The switch assembly of claim 1 wherein:

the switching contacts are dome switching mats.

7. The switch assembly of claim 1 wherein:

the switching contacts are associated with the switching pieces such that latently stored forces produced during the movement of the switching contacts assist in moving the actuating element from a switching position to return to the initial position.

8. The switch assembly of claim 1 wherein:

the control curves are cross-shaped and each have control paths provided with restoring inclines to bias the two spring loaded pressure pieces to move the actuating element from the switching positions to return to an initial position.

9. The switch assembly of claim 1 wherein:

at least one of the control curves includes a central locking cut-out so that the actuating element remains locked in a switching position.

* * * * *